US005274909A

United States Patent [19]

Listing

[11] Patent Number: 5,274,909

[45] Date of Patent: Jan. 4, 1994

[54] WIRE HOLDER FOR APPLICATOR TOOLING

[75] Inventor: Martin Listing, Langen, Fed. Rep. of Germany

[73] Assignee: The Whitaker Corporation, Wilmington, Del.

[21] Appl. No.: 984,030

[22] Filed: Dec. 1, 1992

[30] Foreign Application Priority Data

Dec. 27, 1991 [GB] United Kingdom ..... 9127428

[51] Int. Cl.[5] ..... H01R 43/04

[52] U.S. Cl. ..... 29/753; 29/751; 29/760

[58] Field of Search ..... 29/751, 753, 760, 250, 29/252, 566.3, 566.4, 564.8, 861, 863, 866

[56] References Cited

U.S. PATENT DOCUMENTS

| | | | |
|---|---|---|---|
| 3,406,558 | 10/1968 | Tillman et al. . | |
| 3,707,756 | 1/1973 | Wolyn | 29/203 D |
| 3,866,294 | 2/1975 | McCaughey | 29/753 X |
| 4,361,942 | 12/1982 | Mazzola | 29/33 |
| 4,831,727 | 5/1989 | Johnson et al. | 29/866 |

OTHER PUBLICATIONS

AMP Engineering Drawing, No. 693183 and exploded views of crimping mechanism. 3 sheets. 1977.

*Primary Examiner*—Carl E. Hall
*Attorney, Agent, or Firm*—Eric J. Groen

[57] ABSTRACT

A crimping die comprised of a wire crimping portion and an insulation crimping portion, and an anvil includes a wire retaining mechanism sandwiched therebetween where the wire retaining mechanism includes a wire retaining detent in advance of the crimping surfaces formed on the wire crimp member and the insulation crimp. The wire retaining mechanism is fixedly mounted to the crimping die and insulation crimp member by way of a retaining portion which has been wire eroded from an interior portion of the plate which forms the wire retaining mechanism. A formed spring is wire eroded from the plate portion and is positioned intermediate the retaining portion and the remainder of the plate portion to allow the wire retaining detent to be moveable vertically upward along the crimp axis during the downward movement of the wire crimp member and the insulation crimp member during the normal crimp cycle.

5 Claims, 3 Drawing Sheets

WIRE HOLDER FOR APPLICATOR TOOLING

BRIEF DESCRIPTION OF THE DRAWINGS

1. Field of the Invention

The subject invention relates to applicator tooling, and in particular to a wire holder which can be placed intermediate a wire crimper and an insulation crimper for retaining the individual strands of a stranded wire, during the wire crimping process.

2. Description of the Prior Art

Much time and effort is devoted to crimp technology of electrical wires to electrical terminals. Particularly with stranded wires, it is quite important to arrange the strands in a uniform manner prior to crimping, to ensure that the strands are evenly arranged within the crimp barrel to ensure an adequate electrical connection.

An electrical terminal to be crimped generally includes, from front to rear, a contact portion, whether pin, socket, cantilever beam, etc., a wire crimp barrel, and an insulation crimp barrel. A stranded wire to be crimped is stripped at its end, exposing some of the strands, and the strands are inserted in the crimp barrel, and the remainder of the wire, including the insulation is inserted in the insulation barrel. The crimping die includes both a wire crimper and an insulation crimper, where the wire crimper terminates the strands to the wire crimp, and the insulation crimper crimps the strain relief barrel over the insulation.

As the wire crimper and anvil are generally set by vertical spacing only, if some of the strands are strayed, that is not within the wire barrel, when the crimping operation takes place, the crimp will most likely be ineffective, in that some of the remaining wires in the crimp barrel may be loose. Said differently, the crimping die and anvil are set to a certain height, given the volume of strands to fill the crimp barrel. If some of those strands are exterior to the barrel, then the volume of the strands in the crimp barrel will be lower, but the crimp barrel will be crimped to the same dimension, leaving some of the wires within the crimp barrel loose.

SUMMARY OF THE INVENTION

It is an object of the invention then to provide a mechanism for crimp technology, which will maintain the wires in a given wire arrangement prior to, and during the crimp.

The objects of the invention were accomplished by providing a crimping die for providing a crimp wire barrel on an electrical terminal, comprised of a wire crimper and an insulation crimper, the wire crimper being positioned above and adjusted to a position directly above the wire crimp barrel and the insulation crimper being adjusted to a position above the strain relief crimp on a wire terminal to be crimped. The die is characterized in that a wire positioning and retaining mechanism is positioned medially of said wire crimper and said insulation crimper, said wire positioning mechanism being spring loadably mounted to either said wire crimper or said insulation crimper or to both of them and moveable therewith.

BRIEF DESCRIPTION OF THE DRAWINGS

Figure 1:
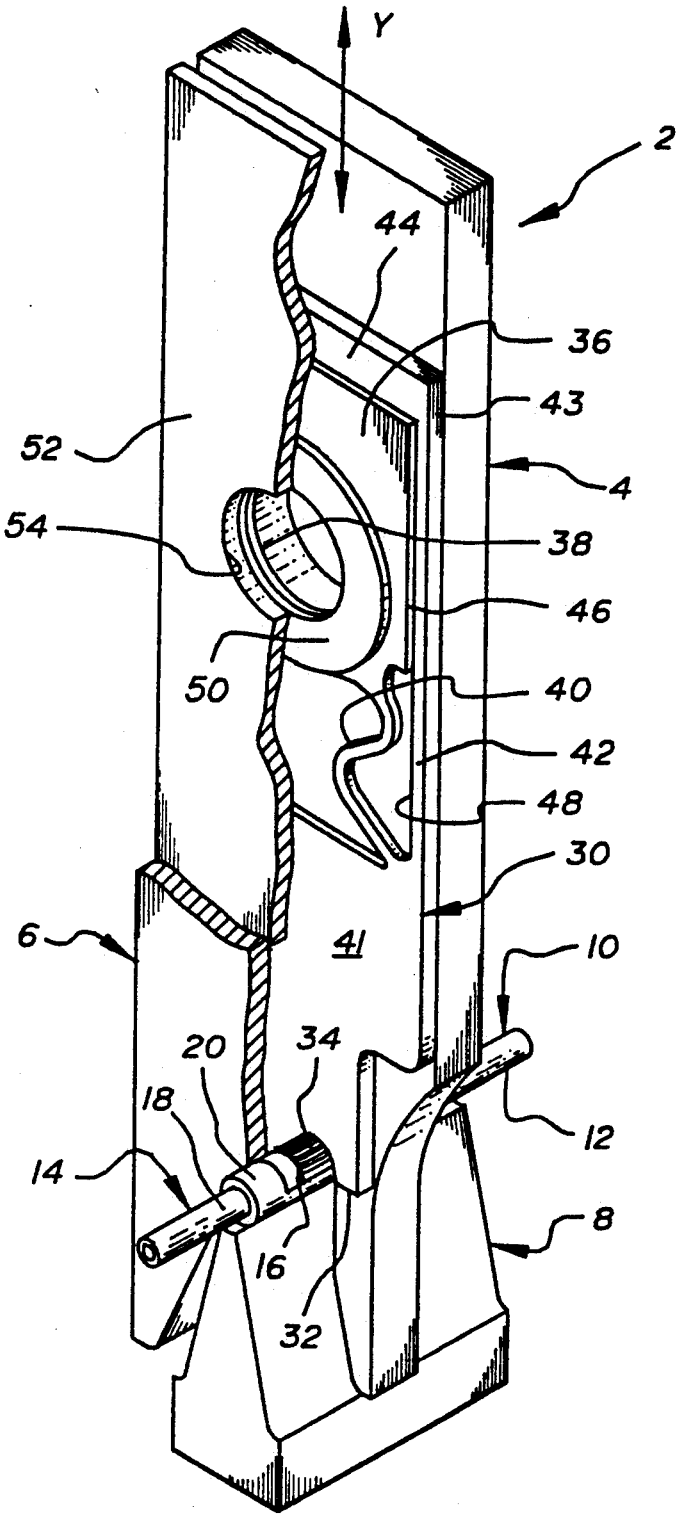
Figure 2:
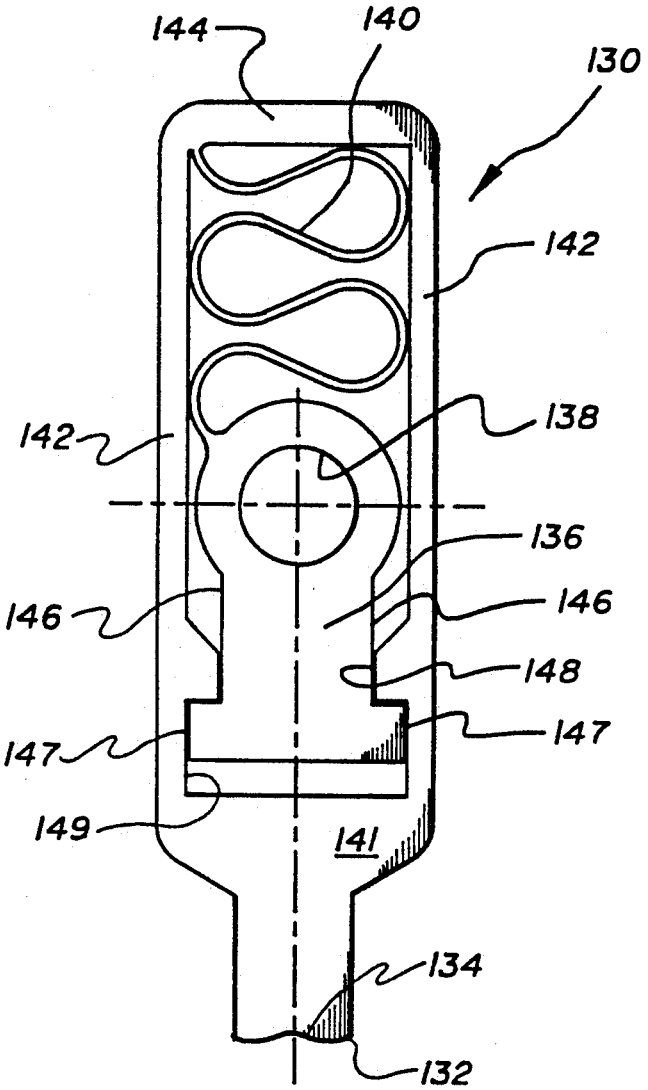
Figure 3:
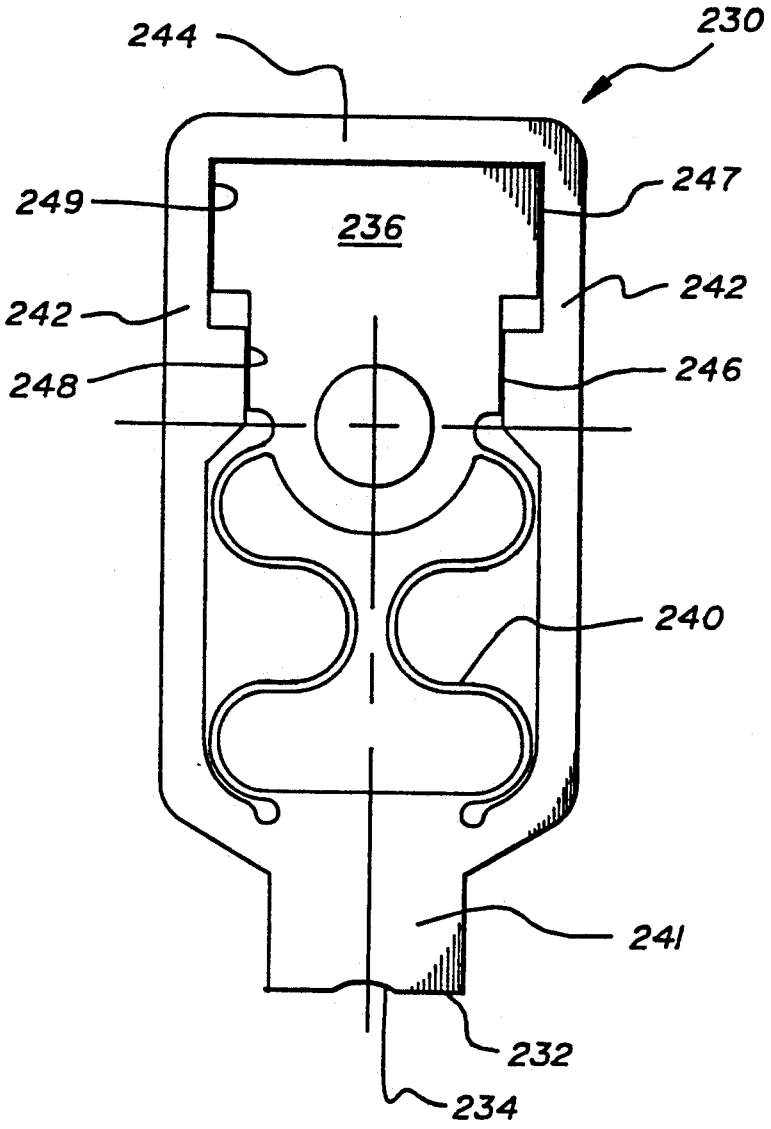

FIG. 1 is an isometric view of the wire holder of the present invention showing the details of the wire holder positioned between the wire crimper and the insulation crimper; and FIGS. 2 and 3 are alternate embodiments of the wire holding mechanism shown in FIG. 1.

BRIEF DESCRIPTION OF THE DRAWINGS

With respect first to FIG. 1, a die assembly shown generally at 2 comprises a wire crimper 4, an insulation crimper 6 spaced apart above an anvil 8. It should be appreciated that the wire crimper and insulation crimper are fixedly mounted to the ram of a press and moveable with the ram along a crimping axis Y towards and away from the anvil 8. It should be appreciated that a terminal such as pin terminal 10 shown in FIG. 1 is insertable on the upper portion of the anvil 8 with the pin portion extending from the anvil 8 at one side thereof while a stripped insulated wire 14 is positioned in the terminal 10 to be crimped. The insulated wire 14 is stripped at its free end to expose the stranded conductors 16 at their ends. The wire 14 is positioned in the uncrimped terminal with the strands 16 in an open crimp barrel (not shown) while the insulation 18 is positioned within the insulation crimp 20 as shown in FIG. 1. The wire crimper 4 and the insulation crimper 6 are spaced apart to accommodate the longitudinal spacing of the crimp barrel and the insulation crimp on the associated terminal 10.

In the preferred embodiment of the invention, a wire holder 30 is positioned intermediate the wire crimper and the insulation crimper and is moveable therewith along the crimp axis Y. In the preferred embodiment of the invention, the wire holder is wire eroded from a flat plate to include a leading edge 32 having a wire centering notch 34 positioned along the leading edge 32 for arranging the stripped conductors 16. The wire holder 30 further includes a retaining portion 36 which is fixed relative to the wire crimper and the insulation crimper by way of a fastener through the opening 38 of the retaining portion 36 and through associated openings in the insulation crimper and the wire crimper. The wire holding mechanism further includes a spring member 40 interconnecting a lower plate portion 41 and the retaining portion 36.

In the preferred embodiment of the invention, the retaining portion 36 is wire eroded from an interior portion of the plate which forms the wire holder, thereby forming a frame comprised of sidewalls 42 (only one of which can be viewed in FIG. 1) and an upper frame wall 44 thereby enclosing the retaining portion 36. The retaining portion 36 is wire eroded along a line parallel to the crimping axis Y thereby forming edges 46 along each side thereof, which, in cooperation with inner edges 48 on the frame members 42, allow the plate portion 41 and the wire aligning detent 34, to be movable along the crimping axis Y, under the influence of the spring 40. The wire holding mechanism is guided within the housing of the applicator (not shown) along side edges 43, shown in FIG. 1.

Also in the preferred embodiment of the invention a circular shim 50 is positioned on one side of the wire holding mechanism 30 to prevent friction between the wire crimper and the insulation crimper. This shim allows the plate portion 41 to move relative to the wire crimper and the insulation crimper and yet be closely spaced between the two. If the longitudinal distance between the wire crimp and the insulation crimp is such that the thickness of the wire retaining mechanism 30 together with the shim 50 does not accommodate the entire space between the wire crimper and the insulation crimper, a spacer plate 52 may also be necessary having an opening 54 alignable with the opening 58 in the wire holding mechanism such that the entire stack can be fastened together.

It should be appreciated that the wire holding detent 34 is positioned along the crimp axis Y in advance of the forming edges of the wire crimper and the insulation crimper, such that upon vertical downward movement along the crimp axis Y, the wire retaining mechanism 30 and in particular the wire retaining detent 34 contacts the wire prior to any formation between the crimp barrel of the terminal and the strain relief barrel 20. Continued downward movement of the applicator tooling, causes upward movement of the plate portion 41 relative to the wire crimper 4 and the insulation crimper 6, via the spring 40. This causes the frame side walls 42 to move relative to the retaining portion 36 such that the wire strands are firmly held in place during the entire movement.

With respect first to FIG. 2, an alternate wire retaining mechanism is shown at 130 including a leading edge 132 having a wire holding detent 134. A retaining portion 136 has a retaining aperture 138 and is moveable relative to the plate portion 141 by way of the spring member 140. Much like the wire retaining mechanism of FIG. 1, the wire retaining mechanism 130 has the retaining portion 136 wire eroded from an interior of the plate thereby forming frame portions 142 and 144 surrounding the retaining portion 136.

Similar to the wire retaining mechanisms of both FIGS. 1 and 2, the wire retaining mechanism 230, shown in FIG. 3, has a leading edge 232 having a wire retaining detent 234 and a retaining portion 236 spaced apart and relatively moveable by way of a spring 240. Like the previous embodiments, retaining portion 236 is wire eroded from an interior portion of the plate thereby forming side frame portions 242 and an upper frame portion 244.

Advantageously then, the wire retaining plate 30, 130, or 230 is relatively thin, and can be accommodated within the spacing between the wire crimper and insulation crimper on standard dies, as this spacing is generally filled only by a spacer anyway. By forming an integral spring, the leading edges 32, 132, and 232 are movable relative to the wire crimper and insulation crimper. This allows the wire retaining detents 34, 134 and 234 to be in advance of the wire and insulation crimpers, to organize the wires for the crimp, and yet maintain pressure on the stripped conductors during the entire crimp.

The embodiment of FIGS. 1–3 are all similar in nature, differing mainly in the design of the spring only, and the overall size of the mechanism itself. This type of wire retaining mechanism is useable with different sized wires applicators, and for example, the mechanism of FIG. 2 is useable with a smaller applicator than that shown in FIG. 3. Both versions are used with a wire range varying between 7 to 24 AWG.

I claim:

1. A crimping die for providing a crimp wire barrel on an electrical terminal, comprised of a wire crimper and an insulation crimper, the wire crimper as positioned above the wire crimp barrel, and the insulation crimper being adjusted to a position above the strain relief crimp on a terminal to be crimped, the die being characterized in that, a wire positioning and retaining mechanism is positioned medially of said wire crimper and said insulation crimper, said wire positioning mechanism being spring loadably mounted to said wire crimper or said insulation crimper, or to both of them, and movable therewith.

2. The crimping die of claim 1, characterized in that said wire positioning mechanism is formed from a flat plate to include a wire holding edge for positioning said wires, a retaining portion affixed to said wire crimper and insulation crimper, and a spring member separated from said plate, medially positioned between said wire holding edge and said retaining portion.

3. The crimping die of claim 2, characterized in that said retaining portion is separated from an interior of said flat plate, and said wire holding edge and the remainder of said flat plate move relative to said central retaining portion.

4. The crimping die according to claim 3, characterized in that said plate portion is separated from said flat plate along separating edges which are parallel to the crimping axis of said die.

5. The crimping die according to any of claims 1–4, characterized in that said wire positioning mechanism positions the wire before the wire or insulation is crimped by the wire crimper or insulation crimper, respectively;

and said wire positioning mechanism is movable via said spring member when said wire and said insulation crimpers are advanced.

* * * * *